United States Patent [19]

Grisebach

[11] 4,046,058

[45] * Sept. 6, 1977

[54] CONTROL SYSTEMS AND ARRANGEMENTS FOR USE IN MINERAL MINING INSTALLATIONS

[75] Inventor: Hans Theodor Grisebach, Unna, Germany

[73] Assignee: Gewerkschaft Eisenhutte Westfalia, Westfalia, Germany

[ * ] Notice: The portion of the term of this patent subsequent to June 29, 1993, has been disclaimed.

[21] Appl. No.: 632,191

[22] Filed: Nov. 17, 1975

Related U.S. Application Data

[62] Division of Ser. No. 423,483, Dec. 10, 1973, Pat. No. 3,965,797.

[51] Int. Cl.[2] ..... F15B 13/04

[52] U.S. Cl. ..... 91/32; 91/36; 91/414; 91/448; 137/624.11

[58] Field of Search ..... 91/36, 424, 32, 2, 14, 91/35, 433, 461, 448, 414, 444; 137/624.11

[56] References Cited

U.S. PATENT DOCUMENTS

| | | | |
|---|---|---|---|
| 3,045,435 | 7/1962 | Weaver | 91/36 |
| 3,352,322 | 11/1967 | Strick | 137/624.11 |
| 3,382,769 | 5/1968 | Raider | 91/167 |
| 3,552,266 | 1/1971 | Tanenblatt | 91/424 |
| 3,605,554 | 9/1971 | Philbrick | 91/424 |
| 3,625,004 | 12/1971 | Holzbock | 91/444 |
| 3,900,090 | 8/1975 | Kobelt | 91/36 |
| 3,926,217 | 12/1975 | Ohishi | 137/624.11 |
| 3,941,031 | 3/1976 | Haddenhorst | 91/36 |

*Primary Examiner*—Martin P. Schwadron
*Assistant Examiner*—Abraham Hershkovitz
*Attorney, Agent, or Firm*—Thompson, Birch, Gauthier & Samuels

[57] ABSTRACT

In a mineral mining installation employing a series of shifting rams for advancing a scraper-chain conveyor provided with a guide for a mining machine a control system with a central control station for transmitting control signals. The control signals serve to actuate local control valves, possibly in time dependence, to cause a selected one or group of metering devices to transfer a pre-determined volume of pressure fluid to one or more of the rams to effect said advancement. This volume of pressure fluid is some fraction of the total capacity of the ram or rams in question so that by repeatedly transmitting control signals the device or devices can perform successive cycles of operation to thereby cause the ram or rams associated therewith to extend in defined increments.

3 Claims, 4 Drawing Figures

CONTROL SYSTEMS AND ARRANGEMENTS FOR USE IN MINERAL MINING INSTALLATIONS

This is a division of application Ser. No. 423,483 filed Dec. 10, 1973, now U.S. Pat. No. 3,965,797.

BACKGROUND TO THE INVENTION

The present invention relates to control systems and arrangements for use particularly, but not solely, in mineral mining installations.

In mineral mining installations employing a mineral winning machine movable along a guide, usually provided on one side of a longwall scraperchain conveyor, it is known to provide a control system for operating shifting rams to cause the guide, and hence the machine, to be advanced towards the mineral face. The guide is usually composed of sections and it is conventional to cause the guide sections to be advanced successively and incrementally by the full cutting depth of the machine after the latter has passed over the guide section in question. The control system may employ a central control station which causes each of the shifting rams, or groups of the rams, to be charged with pressure fluid when shifting is to take place. It is also known to employ devices which provide quantitative control by metering certain quantities of pressure fluid to the rams, In this way the advancement effected by each ram can be controlled so that the guide is advanced uniformly over its length. Usually the metering devices are provided with some form of adjustment to vary the quantity of pressure fluid supplied to the associated ram or rams. In general, the devices are of comparatively large dimensions and supply a volumetric quanitity of fluid commensurate with the total capacity of each of the rams. Moreover, the provision of individual adjustment for each such device increases the overall cost of the control system and involves considerable time in setting up and monitoring the operation of the system.

SUMMARY OF THE INVENTION

A general object of the present invention is to provide improved forms of control systems and arrangements for use in the aforementioned application.

According to the invention there is provided a system for controlling the operation of shifting rams in a mine working; said system comprising a plurality of apportioning devices each allocated to at least one of the rams and adapted, when initiated to perform an operative cycle, to transfer a predetermined volume of pressure fluid to the working chamber of said at least one ram, the volume of pressure fluid being a fraction of the total capacity of said chamber.

In accordance with the invention the apportioning devices can be of comparatively small size and can be combined with the rams to form constructional units therewith. No individual adjustment of the devices is necessary since the maximum working volumes of the devices is far smaller than that of the rams and hence the devices can perform various numbers of operative cycles to control the total quantity of fluid supplied to their associated rams. Preferably a central control station is connected to control lines which transmit control signals to selectively initiate one or more of the devices. Each control signal provided by the control station may initiate one operative cycle of the device in question so that a series of signals can provided repetitive cycles.

If the depth of cut of a mining machine supported on a guide advanced by the shifting rams is say 6 cm., then in general the guide sections should be advanced by 6 cm., when the machine has passed and this would, in accordance with the invention, involve a number of operative cycles of the associated apportioning device to cause the ram to extend in increments.

It is possible to have two or more adjacent rams connected to one common apportioning device and this enables the number of devices required to be reduced. The volume of fluid supplied by the common device to the associated rams would still be considerably smaller than the total capacity of the rams.

It is preferred for each apportioning device to have a cylinder containing a floating piston, the cylinder having two working chambers each selectively connectible to a pressure fluid supply or to the working chamber of said at least one ram. An operative cycle of the device then comprises connecting each of the working chambers of the cylinder thereof successively to said pressure fluid supply and to said working chamber so that the piston moves in one direction and then in a reverse direction to expel two quantities of pressure fluid collectively constituting said predetermined volume.

As described hereinafter the system can employ connecting valves which control the desired apportioning devices in accordance with the signals from the control station. These control signals would normally be of hydraulic or pneumatic nature although electric signals are also feasible.

It is also possible for the apportioning devices to be controlled by stepping mechanisms, possibly with timing devices, each actuated by control signals but capable of causing the associated device or devices to automatically perform a number of operative cycles dependent on the signals received.

In accordance with a further feature of the invention there are provided actuating valves for initiating the operative cycles of the apportioning devices, each of said actuating valves being connected through at least two valve devices to a pressure fluid supply each of said valve devices having a time-dependent actuating mechanism for actuating a pilot valve which is normally in a closed state and is capable of adopting an open state to allow the passage of pressure fluid therethrough under the control of its time dependent mechanism initiated by a control signal. The valve devices can be advantageously connected in groups to two control lines which serve to transmit the control signals, one of the devices connected to each actuating valve being in one group and the other of the devices connected to the actuating valve being in the other group, the time dependent mechanism of the devices in each group serving to open the pilot valves of the devices at different characteristic time intervals. It is notable that only two control lines are required since the selection of the valve devices to be actuated is governed by time intervals defined by the control signals.

According to another aspect of the invention there is provided a control arrangement for selectively operating one or more units; said arrangement comprising at least two switching devices connected in series between each of the units and an energizing source, such as a pressure fluid source, each switching device being normally in an off state and having a control mechanism capable of causing the device to adopt an on state in dependence on a characteristic time period whereby each unit can only be operated when said at least two devices are both in an on state, the switching devices being arranged in two groups each with its own control line so that one of said at least two devices associated with each unit is in one group and the other of said at least two devices is in the other group, the control mechanisms of the devices in each group having different characteristic time periods and control means for transmitting control signals along the control lines, the control signals being indicative of designating time intervals and serving to cause selected one of the devices in each group with control mechanism having characteristic time periods in pre-determined relationship to the designating time intervals of the control signals to change from the off state to the on state.

The invention may be understood more readily and various other features of the invention may become apparent, from consideration of the following description.

BRIEF DESCRIPTION OF THE DRAWINGS

Embodiments of the invention will now be described, by way of examples only, with reference to the accompanying drawings, wherein.

DESCRIPTION OF PREFERRED EMBODIMENT

Figures 1, 2:
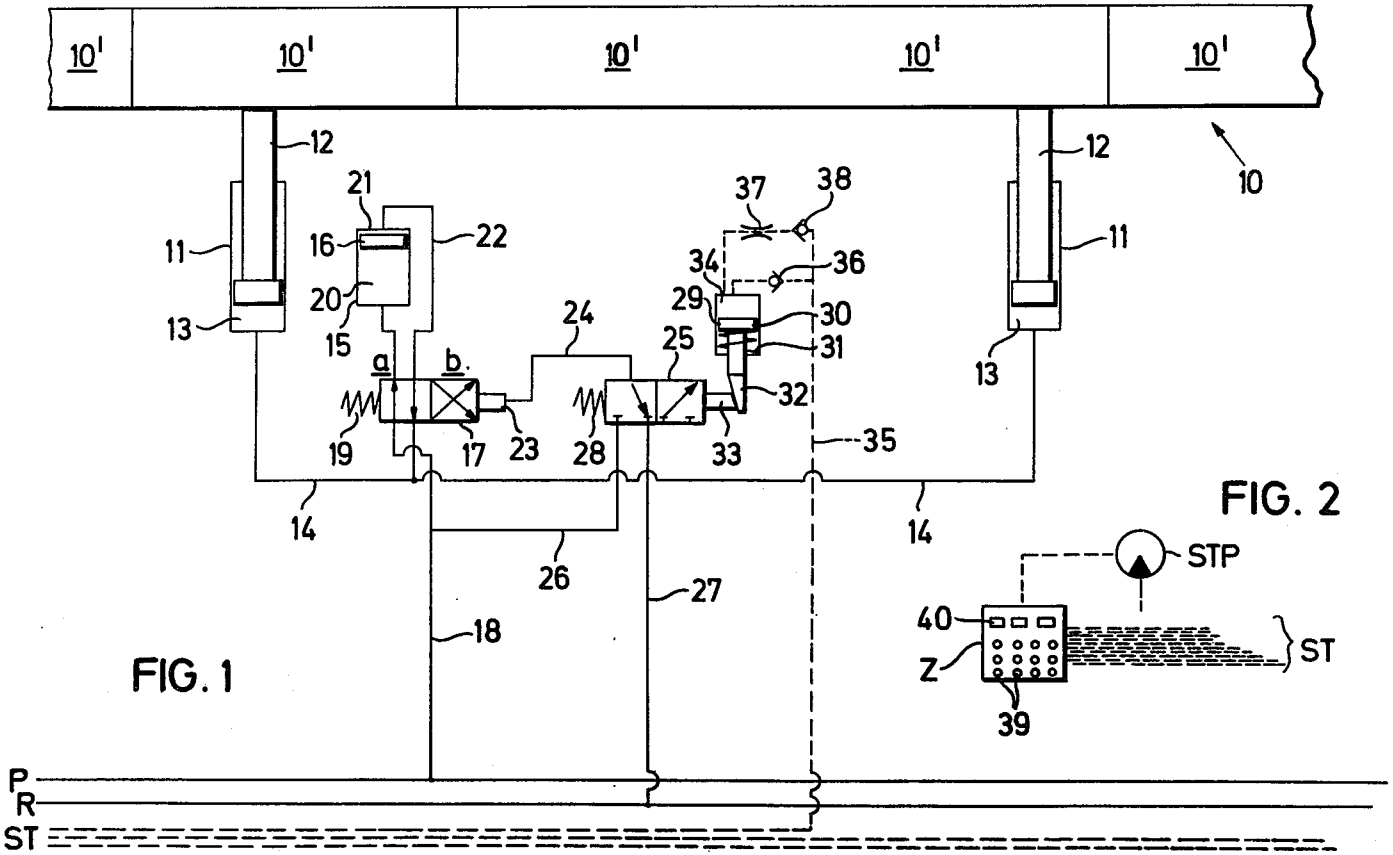
FIG. 1 is a block schematic diagram depicting a control system made in accordance with the invention.
FIG. 2 is a schematic representation of a control station for the system.

Referring initially to FIG. 1 the reference numeral 10 represents a longwall scraper-chain conveyor of a mineral mining installation which conveyor is composed, in known manner, of a series of channel sections 10' arranged end-to-end. A scraper-chain assembly (not shown) is circulated along these channel sections 10'. The channel sections 10' are inter-connected in such a manner as to allow a certain amount of angular mobility between the sections 10' about the longitudinal centre of the conveyor 10. Although not shown in the drawing, the conveyor 10 is provided with a guide means which supports and guides a mineral winning machine, more usually a coal plough, which is moved back and forth along the conveyor to win mineral from a mineral face. In order to advance the guide means, and hence the plough, toward the face to thereby follow up the mineral-winning progress, a series of shifting rams 11 are disposed on the side of the conveyor 10 remote from the mineral face, i.e., on the goaf or stowage side. These rams 11 normally engage on movable roof support frames or units (not shown) which act as abutments for the shifting of the conveyor channel sections 10'. The operation of the rams 11 is usually controlled so that the conveyor channel sections 10' are progressively shifted so that the conveyor 10 performs the so-called incremental advance. As shown in FIG. 1, the rams 11 have piston rods 12 which engage on the goaf or stowage side of the conveyor channel sections 10'. In this control system the pressure chambers 13 of each two adjacent rams 11 are connected in common to a conduit 14 which serves to convey pressure fluid to these chambers 13. An apportioning device 15 serves to meter a quantity of pressure fluid to these chambers 13 via the conduit 14 and the volume of the quantity of metered fluid supplied to each chamber 13 is several times smaller, i.e., a fraction of the total capacity of the chamber 13. Hence, the distance by which the piston rods 12 are extended by the admission of the fluid into the chambers 13 is considerably smaller than the maximum stroke of the rods 12 and this distance is also make smaller than the cutting depth of the winning machine. As shown, the device 15 is in the form of a cylinder with a floating piston 16 movable in relation to two working chambers 21, 20. A connecting valve 17 which can be set to either of the operating states or positions denoted *a* and *i* is connected via conduit 18 to a pressure fluid supply conduit P which is usually laid along the entire mine working. The valve 17 is also connected via a conduit 22 to the working chamber 21 of the device 15 and via a conduit to the conduit 14. The other working chamber 20 of the device is also connected to the valve 17 via a conduit. The valve 17 has a spring 19 which biases the valve 17 into the state *a* in which the chamber 20 of the device 15 is connected to the conduit P via the conduit 18 and the chamber 21 is connected to the conduit 14 via the conduit 22. The valve 17 has a control piston 23 connected to a conduit 24 and when the piston 23 is subjected to pressure it opposes the force of the spring 19 to bring the valve 17 into the state *b* in which the chamber 20 of the device 15 is connected to the conduit 14 and the chamber 21 of the device 15 is connected to the conduit P. The valve 17 may employ a slide element to establish the various connections and this element may be acted upon directly at its ends by the spring 19 and the piston 23.

The conduit 24 is connected to a further valve 25. This actuating valve 25 is also connected via a conduit 26 to the conduit 18 and via a conduit 27 to a pressure fluid return conduit R which is, similar to the conduit P, normally laid along the entire mine working. The valve 25, which may also employ a slide element, is subjected to the action of a spring 28 which biases the valve in the operating state as shown where connection is established between the conduits 24, 27; and the conduit 26 is blocked. The valve 25 has a control element or tappet 33 which, although analogous to the control piston 23 of the valve 17, is in contrast thereto, subjected to the mechanical action of a movable member in the form of an elongate cam 32. This cam 32 has an inclined face at the end of the tappet 33 so that as the cam 32 moves longitudinally, and downwardly as depicted in FIG. 1, the tappet 33 can act on the slide element of the valve in opposition to the force of the spring 28 to bring the valve 25 into its other operating state where connection is established between the conduits 26, 24 whilst the conduit 27 is blocked. The cam 32 is disposed at the end of a piston rod of a piston and cylinder unit 29, 30. A spring 31 biases the piston 30 of the unit 29, 30 towards a pressure chamber 34 to thereby allow the spring 28 to maintain the valve 25 in the state depicted in the drawing. The chamber 34 of the cylinder 29 is connected via a non-return valve 36 to a conduit 35 which leads to one of a group of control lines or conduits ST which convey pressure, preferably pneumatically, to the chamber 34. A throttle device 37 and a non-return valve 38, opening in the opposite direction to the valve 36, are connected in parallel to the valve 36. The conduits ST are also laid along the mine working and each conduit of the group ST is connected to a respective one of the units 29, 30 to thereby, in this embodiment, control the operation of two adjacent rams 11. The conduits ST lead back to a central control station denoted Z in FIG. 2, whereat a plurality of switches 39, 40, which can be manually operated, serve to establish connection between a selected one or more of the conduits of the group ST and a pressure source or pump STP. The switches 39 are allocated to the individual devices 15 so that each device 15 can be selected and operated by actuation of the appropriate switch 39. The switches 40 in contrast serve for group control where each switch 40 selects and operates a group of devices 15 ranging for example from two to ten devices 15.

To assist in the understanding of the invention a typical sequence of events will be described. Assume that one of the switches 39, is actuated to apply pressure from the source STP to the conduit connected to the unit 29, 30 shown in the drawing. This pressure is transmitted through the conduit 35 and the valve 36 to the pressure chamber 34 thereby causing the piston 30 to move against the force of the spring 31 and to extend the piston rod out of the cylinder 29. The cam 32 thus causes the tappet 33 to move inwardly of the valve 25 to overcome the force of the spring 28 to connect the conduits P, 18, 26 to the conduit 24 thereby causing pressure to act on the piston 23. This, in turn, causes the valve 17, in opposition to the force of the spring 19, to assume the state *b* so that the chamber 21 of the device 15 is exposed to pressure via the conduits 18, 22. The piston 16 of the device 15 then moves to expel pressure fluid from the chamber 20 and this pressure fluid passes into the conduit 14 and thence to the chambers 13 to cause the piston rods 12 of the rams 11 to extend by a pre-determined amount, somewhat less than the cutting depth of the mining machine. The switches 39, 40 are so designated that the pressure which is transmitted from the source STP to the unit 29, 30 via a selected one of the conduits ST only prevails for a sufficient time to allow the sequence of events just described to take place. Thereafter the pressure is cut off to the conduit 35 and the pressure in the chamber 34 is able to vent via the throttle device 37 and the valve 38 under the action of the spring 31 which urges the piston 30 inwards. The spring 28 now restores the valve 25 to its former state and the conduit 24 is now connected to the return conduit R to relieve the piston 23. The spring 19 then reverts the valve to the state *a* where the chamber 20 of the device 15 is connected to the conduit P via the conduit 18 and the chamber 21 of the device 15 is connected to the conduit 14 via the conduit 22. The piston 16 thus moves to expel pressure fluid from the chamber 21 to the conduit 14 and thence once again to the chambers 13 thereby causing the piston rods 12 to extend by the pre-determined amount again. It can be appreciated that the complete operative cycle initiated by pressure in one of the conduits ST and terminated with the cessation of this pressure causes the piston rods 12 to extend by two increments. This sequence can be performed a number of times by re-actuating the appropriate switch or switches 39, 40 so that the distance by which the piston rods 12 are extended can be accurately controlled.

In a modified system each ram 11 has allocated thereto its own apportioning device 15 so that each ram 11 can be controlled individually or in groups by actuation of one or more of the selection switches 39 or 40. The switches 39, 40 can be operated manually, as already mentioned, or by some remote control. The devices 15 can be of moderate dimensions and hence can be combined with the or one of the associated rams 11 as a constructional unit. Similarly the valves 17 and 25 and the units 30 can be conveniently embodied in constructional units mounted for example on the roof support units.

It is possible to provide some form of stepping mechanism which is allocated to each device 15 or to a group of devices 15. This mechanism can be conveniently mounted on the roof supports and operated via signals generated at a control station. The mechanisms would replace the units 29, 30 so that each mechanism would operate the or each associated valve 25 and hence the valve or valves 17 when a control signal is received. The mechanisms can be designed to provide different numbers of strokes by the or each associated device 15 and provision can be made to also remotely control the desired number of strokes to be performed by the device or devices 15 in question. Thus, each mechanism can be provided with some form of control means initiated by a control signal which enables the valves 17, 25 and devices 15 associated therewith to perform a pre-set number of cycles to thereby cause the rams or rams 11 in question to be extended by a desired amount.

It should be mentioned that in the system illustrated in FIG. 1 and described above, the unit 29, 30 is not strictly essential since it is quite feasible to operate the valve 25 or indeed the valve 17 directly from the designated control conduit ST.

Figure 4:
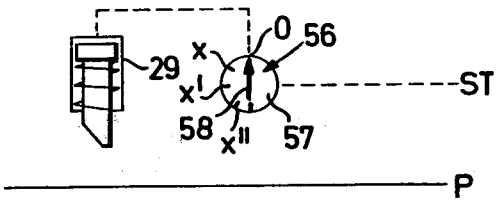

FIG. 4 depicts a timing device which can be incorporated in the system shown in FIG. 1. The device, designated 56 is connected to one of the conduits or lines ST and serves to operate the unit 29, 30 (FIG. 1) although it could operate the valve 17 or 25 directly. The device 56 is constructed so that it performs one timing cycle whenever it receives a signal, which can be electrical, hydraulic or pneumatic, from the line ST. To represent this action the device 56 is depicted as having an indicator 58 which moves over a scale 57. When the device 56 receives a first signal the indicator 58 moves to position *x*, a second signal to position *x'* and so one. Each of these positions *x, x', x''* corresponds to a cycle or number of cycles of operation of the associated device 15, and it is convenient to assume that the indicator 58 of the device 56 moves back to its initial neutral position O after the control signal or signals have ended and thereby initiates one or more cycles of operation of the device 15. Hence, if it is desired to make the device 15 perform two cycles of operation then two control signals are transmitted along the line ST. The indicator 58 adopts the position *x'* and then initiates one cycle of operation of the device 15. The indicator 58 next moves to position *x* and a further cycle of operation of the device 15 takes place. Finally, the indicator 58 reverts to the neutral position and is ready to be actuated again by a fresh signal or signals. The device 56 may be a simple clockwork mechanism.

Figure 3:
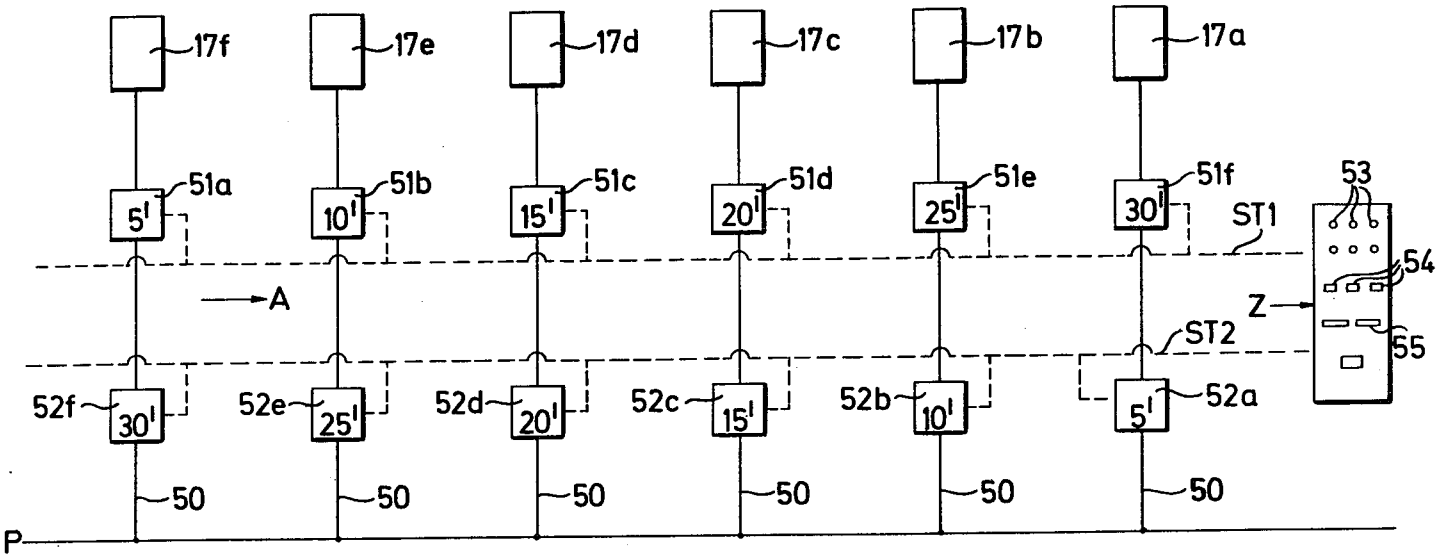
FIG. 3 is a schematic representation of a control arrangement usable in the control system and FIG. 4 is a schematic representation of a timing device usable in the system shown in FIG. 1.

The operation of the valves 17 can also be effected by time-controlled valve devices as represented in FIG. 3. There is shown in FIG. 3, a series of valves 17*a* to 17*f,* corresponding to the valve 17 in FIG. 1, which are each connected to a respective one of a series of apportioning devices 15 (not shown). Each valve 17*a* to 17*f* is connected via a conduit 50, corresponding to the conduit 18 in FIG. 1, to the pressure fluid supply conduit P. In each conduit 50 there are time-controlled valve devices 51*a* to 51*f* and 52*a* to 52*f.* The valve devices 51*a* to 51*f* are connected to a control line ST1 and the valve devices 52*a* to 52*f* are connected to a control line ST2. Each valve device 51*a* to 51*f* and 52*a* to 52*f* is composed of a pilot valve which is operated by a timing mechanism to be either open or closed. The timing mechanisms of the valve devices 51*a* to 51*f* and 52*a* to 52*f* are controlled by signals transmitted along the lines ST1 or ST2. In one form of construction the control signals transmitted along the control lines ST1, ST2 are of different duration to effect selection of the valve devices it is desired to open. In the case of the valve devices 51*a* to 51*f* the time setting of the timing mechanisms, which corresponds to the duration of the designating control signals, differs from one device to the next and increases in the direction of arrow A. In a specific case, the time setting for the valve device 51*a* is 5 seconds and this setting increases by 5 second increments in the direction of arrow A so that the delay for the last device 51*f* is 30 seconds. In the case of the valve devices 52*a* to 52*f* the situation is reversed to that the time setting increases in the opposite direction to arrow A with the setting for the device 52*a* being 5 seconds and the setting for the final device 52*f* being 30 seconds. The valve devices with the same suffixes, i.e., *a* to *b* etc., in the groups 51*a* to 51*f* and 52*a* to 52*f* thus have the same time settings.

The control lines ST1, ST2 are connected to a control station Z provided with selector switches 53, 54, 55. By actuating the switches 53—55 to transmit control signals of certain durations and corresponding to the time settings of the valve devices 51*a* to 51*f* and 52*a* to 52*f* selected ones of the devices can be operated to allow pressure fluid to flow from the conduit P to one of the valves 17*a* to 17f. Thus to take a specific example if the valve 17*c* is to be connected to the conduit P then the switches 53, 54, 55 of the control station Z are actuated so that a signal of duration 20 seconds is transmitted over the control line ST1 and a signal of duration 15 seconds is transmitted over the control line ST2. The signal on line ST1 causes all the valve devices 51*a* to 51*f* which have a time setting which does not exceed 20 seconds to be actuated so that in this case the valve devices 51*a* to 51*d,* inclusive, open. The signal on line ST2 likewise causes all the valve devices 52*a* to 52*f* which have a time setting which does not exceed 15 seconds to be actuated so that in this case the valve devices 52*a* to 52*c* inclusive, open. Thus only in the conduit 50 connected to the valve 17*c* are the two valve devices 51*d,* 52*c* open and hence the valve 17*c* is subjected to pressure fluid. This valve 17*c* now operates the associated apportioning device 15 to charge the or each pressure chamber 13 of the associated ram or rams 11. If two of the valves 17*a* to 17*f,* say the valves 17*c* and 17*d,* are to be operated simultaneously then a signal of duration 15 seconds is transmitted along the control line ST1 and a signal of duration 25 seconds is transmitted along the control line ST2. The valve devices 51*a* to 51*c* and 52*a* to 52*e* will thus open so that the valves 17*e* 17*d* are connected through the open valve devices 51*b* 52*e* and 51*c* 52*d* to the conduit P.

In general, by actuating the appropriate switches 53–55 at the control station Z the valves 17*a* to 17*f* can be connected, individually or in a group, to the conduit P to thereby cause the associated apportioning device or devices 15 to operate the desired rams or rams 11.

The control signals transmitted over the lines ST1, ST2, can be electrical, hydraulic or pneumatic signals. The time-controlled mechanism of each valve device 51*a* to 51*f* and 52*a* to 52*f* can be constructed to automatically close the pilot valve thereat after it has been open for a pre-determined time. Alternatively the pilot valves can be closed after reception of a further control signal transmitted over the control line ST1 or ST2 or after completion of the stroke of the associated apportioning device 15. In the latter case the closing signal can be generated by the devices 15 themselves.

Instead of providing control signals of set durations to cause the valve devices 51*a* to 51*f* and 52*a* to 52*f* to open, the timing mechanisms can be triggered by a control signal of short noncritical time duration. In this modified construction the presence of an initiate signal on the line ST1 will cause the timing mechanisms of the valve devices 51*a* to 51*f* to respond and likewise the presence of an initiate signal on the line ST2 will cause the timing mechanisms of the valve devices 52*a* to 52*f* to respond. The timing mechanisms of the devices 51*a* to 51*f* and 52*a* to 52*f* will run for the designated setting, i.e., 5 seconds in the case of devices 51*a,* 52*a,* 10 seconds in the case of devices 51*b,* 52*b* and so on. When the timing mechanism of any device 51*a* to 51*f* and 52*a* to 52*f* has run for its complete setting time the associated pilot valve will be opened. Thus, after an initiation signal the valve devices 51*a* to 51*f* will open in succession at intervals of 5 seconds. The opening of the pilot valves of the devices 51*a* to 51*f* and 52*a* to 52*f* will however be over-riden by the transmission of a stop signal along the line ST1 or ST2 which will cause the timing mechanisms of the devices which are still closed to revert to their former state. Thus, to take a specific example, if the valve 17*d* is to be operated, an initiate signal is transmitted along each of the lines ST1, ST2 so that all the timing mechanisms of the devices 51*a* to 51*f* and 52*a* to 52*f* will respond and in the absence of stop signals, the mechanisms will open their respective pilot valves at intervals of 5 seconds, 10 seconds etc., respectively. A stop signal is however transmitted along one line ST1 after 15 seconds have elapsed. As a result the pilot valve of the devices 51*a* to 51*c* will already be open and will remain open whereas the timing mechanisms of the devices 51*d* to 51*f* will revert to their initial state and their pilot valves will remain closed. Likewise, a stop signal is transmitted along the line ST2 after 20 seconds have elapsed. As a result of this the pilot valves of the devices 52*a* to 52*d* will be open and will remain open whereas the timing mechanisms of the devices 52*e* and 52*f* will revert to their initial state and their pilot valves will remain closed. It will be appreciated that only the valve devices 51*c,* 52*d* provide a path for pressure fluid that only the valve 17*d* is connected thereby to the conduit P. As before the pilot valves of the devices which are open can be closed again automatically by their mechanisms after a certain time has elapsed or upon reception of a further control signal as described above. In a manner analogous to that previously described the devices 15 and hence the rams 11 can be controlled individually or in groups according to a time sequence which can be generated automatically by the control station Z.

Although the arrangement depicted in FIG. 3 is shown as directly controlling the valves 17*a* to 17*f* it is possible to control the valves 25 or the units 29, 30 in the system shown in FIG. 1. Also the principle involved in the arrangement shown in FIG. 3 may be useful in other applications.

I claim:

1. A system for controlling the operation of shifting rams in a mine working, said system comprising:

a. a plurality of apportioning devices each allocated to at least one of the shifting rams, each said apportioning device having a cylinder containing a floating piston, said cylinder having a first working chamber on one side of said piston and a second working chamber on the other side of said piston, first conduit means for normally connecting said first working chamber to a pressure fluid supply, second conduit means for normally connecting said second working chamber to the working chamber of said at least one ram, a connecting valve mounted in parallel across said first and said second conduit means, said connecting valve having two alternative switching positions, the first position permitting said first and second conduit means to remain in their normally connected condition, the second position connecting said first working chamber to the working chamber of said at least one ram, and said second working chamber to the pressure fluid supply;

b. a stepping mechanism operating said connecting valve; and c. control signal means for actuating said stepping mechanism to operate said connecting valve to cause a selected apportioning device to perform an operative cycle to transfer a predetermined volume of pressure fluid to the working chamber of said at least one ram, the volume of pressure fluid being a fraction of the total capacity of the working chamber.

2. A system for controlling the operation of shifting rams in a mine working, said system comprising:

a. a plurality of apportioning devices each allocated to at least one of the shifting rams, each said apportioning device having a cylinder containing a floating piston, said cylinder having a first working chamber on one side of said piston and a second working chamber on the other side of said piston, first conduit means for normally connecting said first working chamber to a pressure fluid supply, second conduit means for normally connecting said second working chamber to the working chamber of said at least one ram, a connecting valve mounted in parallel across said first and said second conduit means, said connecting valve having two alternative switching positions, the first position permitting said first and second conduit means to remain in their normally connected condition, the second position connecting said first working chamber to the working chamber of said at least one ram, and said second working chamber to the pressure fluid supply;

b. two valve devices located in series between said connecting valve and the pressure fluid supply, each of said valve devices including a pilot valve which is normally closed and a time-dependent actuating mechanism for opening said pilot valve to allow pressure fluid to flow through said valve device;

c. actuating means for operating said connecting valve; and d. control signal means for energizing said time-dependent actuating mechanism and said connecting valve actuating means to cause a selected apportioning device to perform an operative cycle to transfer a predetermined volume of pressure fluid to the working chamber of said at least one ram, the volume of pressure fluid being a fraction of the total capacity of the working chamber.

3. The system of claim 2 wherein said time-dependent actuating mechanism opens said pilot valve for a characteristic time period, said pressure fluid flowing between the pressure fluid supply and said at least one ram only when said two valve devices are both open, said valve devices being arranged in two groups, one group including all upstream valve devices, and the other group including all downstream valve devices, said control signal means being connected through one control line to all upstream valve devices, and being connected through another control line to all downstream valve devices, said upstream and said downstream time-dependent actuating mechanisms having different characteristic time periods, said control signal means energizing said valve devices in a predetermined sequence and at predetermined time intervals.

* * * * *